United States Patent [19]

Reynolds

[11] Patent Number: 4,623,301

[45] Date of Patent: Nov. 18, 1986

[54] OVERFLOW CHECK SYSTEM

[75] Inventor: Richard M. Reynolds, Mumford, N.Y.

[73] Assignee: Helios Research Corp., Mumford, N.Y.

[21] Appl. No.: 676,289

[22] Filed: Nov. 29, 1984

[51] Int. Cl.[4] ..... F04F 5/48

[52] U.S. Cl. ..... 417/54; 417/192; 251/63.4; 137/115

[58] Field of Search ..... 417/54, 151, 182, 185, 417/186, 192, 193; 251/63.4; 137/115

[56] References Cited

U.S. PATENT DOCUMENTS

| | | | |
|---|---|---|---|
| 535,358 | 3/1895 | Davies et al. | 417/193 X |
| 933,147 | 9/1909 | White | 251/63.4 X |
| 978,000 | 12/1910 | Brooke | 417/192 |
| 1,743,684 | 1/1930 | Pedrick | 417/192 X |
| 2,190,109 | 2/1940 | Tinker | 417/192 X |
| 2,288,777 | 7/1942 | Bosonetto et al. | 417/192 |
| 2,313,351 | 3/1943 | Magnuson | 137/115 X |

*Primary Examiner*—William L. Freeh
*Assistant Examiner*—Paul F. Neils
*Attorney, Agent, or Firm*—Stonebraker, Shepard & Stephens

[57] ABSTRACT

An overflow check system 10 blocks overflow from a vapor powered, liquid pressure amplifier 11 except when required during start-up. Amplified output pressure derived from amplifier 11 enables a check valve 27 to close the overflow during operating intervals, and this pressure is trapped at the end of an operating interval to keep check valve 27 enabled and the overflow closed during inoperative intervals. Absence of amplified output pressure, which occurs when a delivery valve 17 opens on demand, overrides or disables check valve 27, opening the overflow line 20 and allowing amplifier 11 to start-up.

17 Claims, 2 Drawing Figures

OVERFLOW CHECK SYSTEM

BACKGROUND

Liquid pressure amplifiers such as injectors and hydrokinetic amplifiers often require a start-up overflow. They receive liquid and vapor which they combine into a pressure amplified output liquid; but to achieve maximum pressure amplification, they require a brief overflow during start-up. After start-up, the overflow line is often subject to subatmospheric pressure and so includes a check valve oriented to block inflow.

Liquid pressure amplifiers can be arranged to receive continuously available liquid and vapor inputs and yet deliver output pressure intermittently via a delivery valve that can open and close on demand. A common example of this is a high pressure washing gun powered by a liquid pressure amplifier and having a delivery trigger operated to be on or off. When such a delivery valve temporarily closes, the amplifier cannot deliver output pressure and stops operating. The input liquid and vapor continue to flow, however, and pour out the overflow line, wasting both liquid and energy. When the delivery valve reopens, the amplifier restarts, which stops the overflow.

I have discovered a way of checking the overflow whenever it is not required for start-up. This includes blocking any overflow that occurs while a liquid pressure amplifier is operating and also blocking overflow of liquid and vapor inputs when a closed output line prevents the amplifier from operating. My arrangement limits overflow to a negligible amount that occurs only during an actual startup, and my system otherwise contains all the liquid and vapor except that volume deliberately delivered as pressurized liquid output. My invention thus reduces waste and improves the efficiency of a liquid pressure amplifier while allowing it a start-up overflow that is necessary for maximum pressure amplification.

SUMMARY OF THE INVENTION

My system checks all non-start-up overflow of liquid and vapor supplied to a liquid pressure amplifier. I use a check valve oriented to block the overflow and a spring-biased element for holding the check valve open to permit overflow during start-up. I apply amplified output pressure from operation of the amplifier to move the spring-biased element to a position enabling the check valve to close the overflow, and I hold the applied output pressure during an inoperative interval to hold the element against the spring bias and maintain the enablement of the check valve to keep the overflow closed. My preferred way of holding the amplified output pressure is to trap it between a closed delivery valve and an output line check valve blocking backflow. I then use loss of the trapped output pressure upon reopening of the delivery valve to move the element to a position disabling the check valve and opening the overflow, thereby allowing the amplifier to start. Any leakage or accidental loss of the trapped pressure has a similar effect in enabling the amplifier to start and build up an amplified output pressure, which is then applied to close the overflow check valve. The result, from the user's point of view, is that pressurized output delivery can be on or off with no wasted overflow, yet overflow is available to the extent needed for a high gain pressure amplification system.

DRAWINGS

FIG. 1 is a schematic diagram of a preferred arrangement of my overflow check system; and FIG. 2 is a partially schematic, cross-sectional view of a preferred embodiment of pressure controlled check valve for use in the overflow check system of FIG. 1.

DETAILED DESCRIPTION

Figure 1:
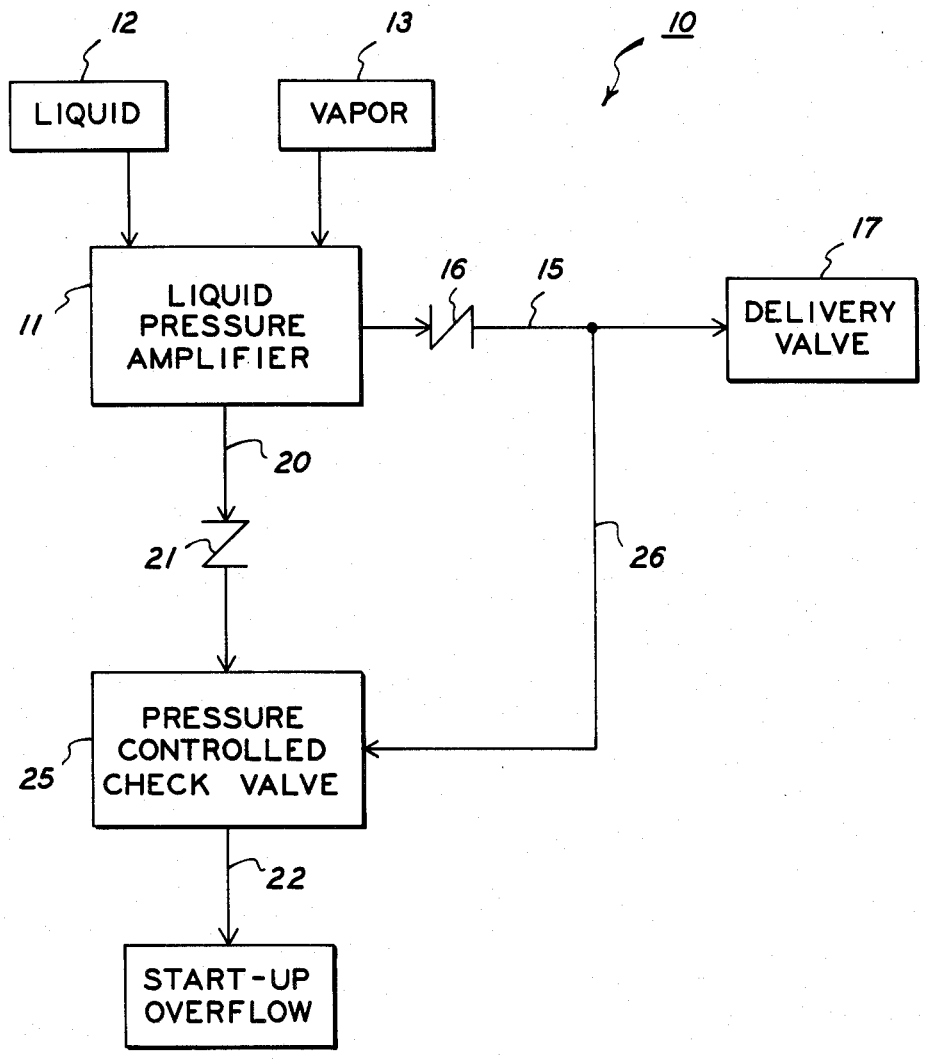

My invention applies to vapor powered, liquid pressure amplifiers. These include injectors such as known in the steam power art and hydrokinetic amplifiers more recently invented by Carl D. Nicodemus as explained in U.S. Pat. No. 4,569,635, entitled Hydrokinetic amplifier. Such liquid pressure amplifiers can be supplied with water and water vapor or steam to output water at an amplified pressure for a variety of purposes that can include washing and boiler feed water return. Hydrokinetic amplifiers are not limited to these uses or to water and water vapor, and they can be operated with other liquids and vapors.

The liquid pressure amplifiers to which my invention applies have start-up overflows that enable liquid and vapor to escape during a brief, start-up interval after which overflow is not required. Since an overflow line is often subject to negative pressure after an amplifier starts, a check valve is usually placed in the overflow line to block inflow that would degrade performance. It is also possible for an overflow line to have a positive pressure while the amplifier is operating, but inputs are adjusted to avoid this because of the wasteful overflow that would occur.

It is also possible to start a liquid pressure amplifier without any overflow if the amplifier is made to produce much less pressure amplification than would otherwise be possible with the available input liquid and vapor supplies. Eliminating start-up overflow thus greatly reduces the pressure gain that would be possible if a start-up overflow were used.

My system allows an overflow to occur during start-up as required to enable a liquid pressure amplifier to achieve a high pressure gain. By system otherwise keeps the overflow closed, both to avoid any wasteful overflow during inoperative intervals and also to allow an amplifier to operate at input values producing a positive pressure to the overflow line. For example, supplying vapor in excess of the vapor required for maximum output pressure can increase output temperature and can be desirable in some circumstances, even though it also applies a positive pressure to an overflow line. My invention accommodates this by blocking the overflow line whenever an amplifier is producing amplified output pressure. My invention also keeps an overflow line blocked after an amplifier has stopped operating—all as explained below.

My overflow check system 10 applies to a liquid pressure amplifier 11 receiving a liquid input 12 and a vapor input 13 and having an output line 15 and an overflow line 20. A check valve 16 is oriented in output line 15 to block any backflow, and a delivery valve 17 can open and close output line 15 on demand. Check valve 21 in overflow line 20 is oriented to block any inflow in response to a negative pressure in overflow line 20 during operation of amplifier 11.

A pressure controlled check valve 25 is oriented in overflow line 20 opposite to check valve 21 so as to block overflow output through lines 20 and 22. A shut-off line 26 applies amplified output pressure from line 15 to enable check valve 25 to close whenever adequate pressure exists in shut-off line 26. Otherwise, lack of amplified output pressure from amplifier 11 disables or overrides check valve 25 to open overflow lines 20 and 22.

Figure 2:
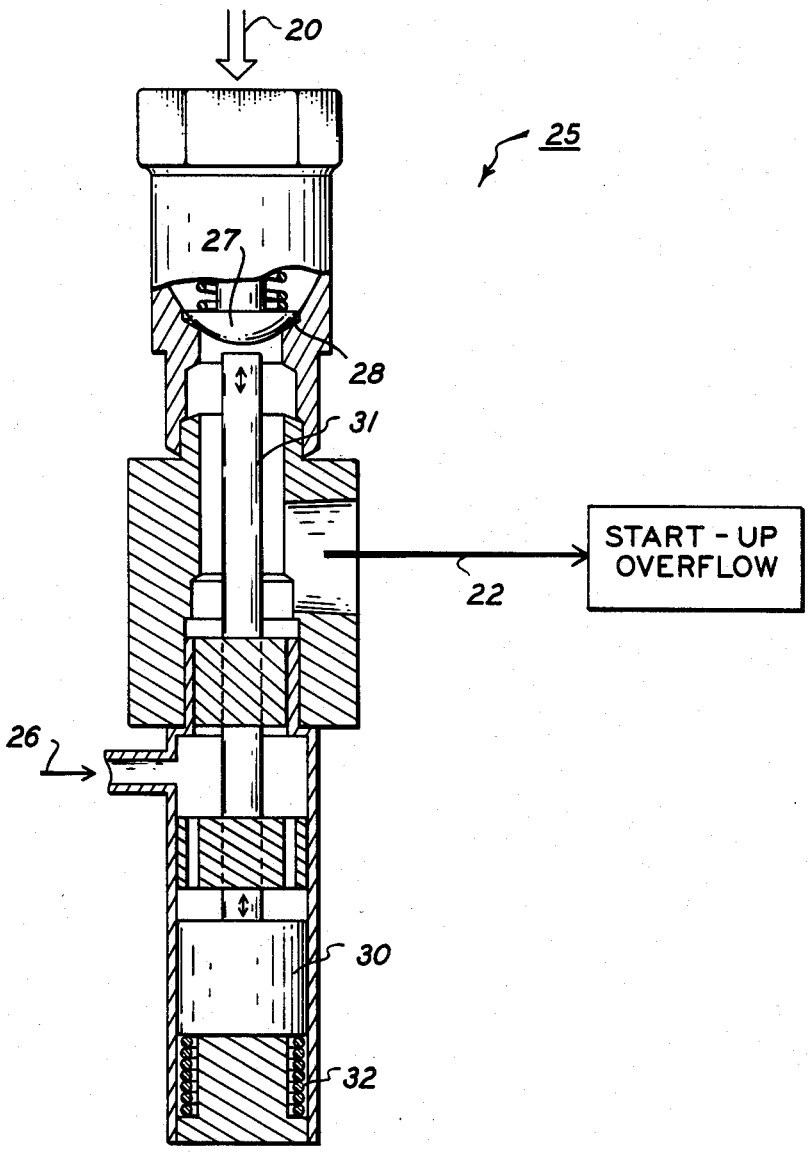

A preferred arrangement for pressure controlled check valve 25 as shown in FIG. 2 includes a check valve head 27 and its seat 28 and a piston 30 arranged to move a stem 31 that can override valve head 27 and hold it open or move away from valve 27 and enable it to close. A spring 32 biases piston 30 to override or disable check valve 27, and pressure from shut-off line 26 moves piston 30 against spring 32 to enable check valve 27 to close. Overflow via line 20 is either blocked by closure of check valve 27 or allowed to pass through line 22 for a start-up overflow if check valve 27 is held open by spring 32 in the absence of pressure on piston 30.

In operation, pressurized liquid and vapor from supplies 12 and 13 can be continuously available to amplifier 11, which delivers pressurized liquid to valve 17 via output line 15. For a brief interval during start-up, output flows at low pressure in line 15; but once amplifier 11 starts, it quickly increases the pressure in line 15 to an amplified output pressure. This is applied via shut-off line 26 to piston 30 to enable check valve 27 to close, blocking overflow through lines 20 and 22. If delivery valve 17 closes and blocks output line 15, amplifier 11 stops operating. However, closure of delivery valve 17 traps amplified output pressure in line 15 between check valve 16 and closed delivery valve 17. This holds piston 30 against spring 32 and maintains the enablement of check valve 27 to block overflow during inoperative intervals.

When delivery valve 17 reopens in response to a demand for liquid output, this drops the pressure in output line 15 and shut-off line 26, allowing spring 32 to move piston 30 to unseat valve head 27 with stem 31. This overrides check valve 27 and opens a start-up overflow path via lines 20 and 22. Overflow of liquid and vapor then occurs for a brief start-up interval enabling amplifier 11 to start. As soon as this occurs, pressure builds up in output line 15 and shut-off line 26, which reapplies amplified pressure to piston 30, retracting stem 31 and enabling check valve 27 to reclose and block overflow.

During operation of amplifier 11, any positive pressure in overflow line 20 is blocked by check valve 27, and any negative pressure in overflow line 20 is blocked by check valve 21. If trapped pressure in shut-off line 26 leaks away or is otherwise lost during an inoperative interval of amplifier 11, the pressure loss opens check valve 27, which automatically starts amplifier 11, and this quickly reestablishes amplified output pressure, which recloses the overflow.

My system has the advantage of using simple components operated by liquid output pressure available whenever amplifier 11 is operating. By using this amplified pressure during operative intervals and trapping it during inoperative intervals, my system keeps the overflow closed at all times except during start-up when it is required to be open.

I claim:

1. A system for checking overflow of liquid and vapor supplied to a vapor powered liquid pressure amplifier during an inoperative interval of said amplifier, which, during an operative interval, combines said liquid and vapor into an amplified output pressure, said system comprising:

a. an overrideable check valve oriented to block said overflow;

b. means for applying said amplified output pressure from said amplifier to remove the override and enable said check valve to block said overflow; and c. means for holding said applied pressure to enable said check valve to stay closed during said inoperative interval.

2. The system of claim 1 wherein said means for holding said applied pressure includes a delivery valve closed during said inoperative interval and an output check valve blocking backflow to said amplifier.

3. The system of claim 2 including an inflow check valve arranged to block inflow to said amplifier via said overflow.

4. An overflow check system for a vapor powered liquid pressure amplifier, having liquid and vapor inputs combined into an amplified output pressure delivered intermittently, said system comprising:

a. a check valve arranged to block said overflow;

b. a spring-biased piston arranged for overriding said check valve;

c. means for applying said amplified output pressure from said amplifier to urge said piston against said spring bias to cancel the override and thereby enable said check valve to block said overflow; and d. means for maintaining said applied pressure from said amplifier between a delivery valve closed at the beginning of an inoperative interval and an output check valve blocking backflow to said amplifier.

5. The system of claim 4 including another check valve oriented to block inflow via said overflow.

6. A system for checking overflow of liquid and vapor supplied to a vapor powered liquid pressure amplifier during an inoperative interval of said amplifier, which combines said liquid and vapor into an amplified output pressure delivered intermittently, said system comprising:

a. a check valve oriented to block said overflow;

b. spring-biased means for holding said check valve open to permit overflow;

c. means for applying said amplified output pressure from said amplifier to move said spring-biased means for enabling said check valve to close said overflow; and d. means for holding said applied pressure during said inoperative interval to hold said element against said spring bias and maintain the enablement of said check valve to close said overflow.

7. The system of claim 6 wherein said pressure holding means includes a delivery valve that is closed during said inoperative interval and an output check valve blocking backflow to said amplifier.

8. The system of claim 7 including an inflow check valve arranged to block inflow to said amplifier via said overflow.

9. A circuit for a vapor powered liquid pressure amplifier having continuously available liquid and vapor inputs combined within said amplifier into an amplified output pressure delivered intermittently, said circuit comprising:

a. normally open liquid and vapor input lines to said amplifier;

b. a start-up liquid overflow line leading from said amplifier;

c. a pressurized liquid output line leading from said amplifier;

d. an overflow check valve oriented to block overflow through said overflow line;

e. a spring-biased element arranged for holding said overflow check valve open;

f. a shut-off line arranged for conducting amplified pressure from said output line to said element to overcome said spring bias with pressure in said shut-off line to enable said check valve to close and block said overflow in response to pressure in said output line;

g. an output check valve arranged upstream of said shut-off line to block backflow in said output line; and h. a delivery valve arranged in said output line downstream of said shut-off line to close during an inoperative interval and maintain said shut-off line pressure enabling said check valve to close.

10. The circuit of claim 9 including an inflow check valve arranged to block inflow to said amplifier via said overflow.

11. A method of checking non-start-up overflow from a vapor powered liquid pressure amplifier having continuously available liquid and vapor inputs combined into a pressurized liquid output delivered intermittently, said method comprising:

a. orienting an outflow check valve to block said overflow;

b. disabling said outflow check valve from closing during start-up intervals when amplified output pressure is unavailable from said amplifier;

c. using amplified output pressure produced by operation of said amplifier for enabling said outflow check valve to block said overflow; and d. using an inflow check valve oriented to block inflow to said amplifier via said overflow.

12. The method of claim 11 including using a spring-biased piston for said disabling of said outflow check valve from closing and using said amplified output pressure to urge said piston against said spring bias for enabling said outflow check valve to close.

13. The method of claim 11 including using a piston movable by said amplified output pressure for enabling said outflow check valve to close and applying spring bias counter to said amplified output pressure to urge said piston to a position disabling said outflow check valve.

14. The method of claim 11 including storing said amplified output pressure during an inoperative interval by trapping said amplified output pressure between an output check valve blocking backflow of said output and a downline delivery valve that is closed during said inoperative interval.

15. A method of checking overflow of liquid and vapor inputs to a vapor powered liquid pressure amplifier during an inoperative interval of said amplifier, which combines said liquid and vapor inputs into an amplified output pressure delivered intermittently, said method comprising:

a. applying said amplified output pressure from said amplifier to move an element to a position enabling an overflow check valve to block said overflow whenever said amplified output pressure exists;

b. trapping said amplified output pressure between a delivery valve closed at the beginning of said inoperative interval and an output check valve blocking backflow to said amplifier to maintain enablement of said overflow check valve during said inoperative interval; and c. using loss of said trapped pressure upon reopening of said delivery valve to move said element to a position disabling said overflow check valve and opening said overflow, thereby allowing said amplifier to start.

16. The method of claim 15 including using a piston for said movable element and using a spring biasing said piston against said trapped pressure.

17. The method of claim 15 including using an inflow check valve to block inflow to said amplifier via said overflow.

* * * * *